United States Patent [19]

Peterson

[11] 4,398,971

[45] Aug. 16, 1983

[54] METHOD OF HEATING, HOLDING OR HEAT TREATMENT OF METAL MATERIAL

[75] Inventor: Rune Peterson, Västerås, Sweden

[73] Assignee: Aga Aktiebolag, Lidingoö, Sweden

[21] Appl. No.: 337,087

[22] PCT Filed: May 5, 1981

[86] PCT No.: PCT/SE81/00134

§ 371 Date: Dec. 31, 1981

§ 102(e) Date: Dec. 31, 1981

[87] PCT Pub. No.: WO81/03184

PCT Pub. Date: Nov. 12, 1981

[51] Int. Cl.[3] ..... C21D 1/48

[52] U.S. Cl. ..... 148/16; 148/16.6

[58] Field of Search ..... 148/16, 16.6; 75/224

[56] References Cited

U.S. PATENT DOCUMENTS

| | | | |
|---|---|---|---|
| 3,290,030 | 12/1966 | Goehring | 148/16 |
| 4,106,931 | 8/1978 | Nayar | 148/16 |
| 4,153,485 | 5/1979 | Ogata et al. | 148/16 |
| 4,167,426 | 9/1979 | Snyder et al. | 148/16 |
| 4,294,630 | 10/1981 | Watauabe et al. | 148/16.6 |

FOREIGN PATENT DOCUMENTS 776358 6/1957 United Kingdom .

OTHER PUBLICATIONS

Metals Handbook, 8th Ed., vol. 2, Heat Treating, Cleaning and Finishing, Am. Soc. Metals, 1964, pp. 74–78.

*Primary Examiner*—Veronica O'Keefe

*Attorney, Agent, or Firm*—Hill, Van Santen, Steadman & Simpson

[57] ABSTRACT

In an indirectly heated, gas-fired furnace (10) for the heat treatment of metal material in an atmosphere of processing gas consisting predominantly of nitrogen, the processing gas is produced using the heating exhaust gases as the principal raw material. The exhaust gases are cooled, filtered and freed of carbon monoxide and water vapor, whereupon a small amount of air is added to impart a predetermined value to the oxygen content and a controlled amount of liquefied petroleum gas or other hydrocarbon gas is added. A processing gas consisting predominantly of nitrogen, hydrogen and carbon monoxide is produced by thermal cracking of the liquefied petroleum gas in a catalytic reactor (25) and fed to the furnace (10). If a processing gas free of carbon and consisting predominantly of nitrogen and hydrogen is required, the reactor (25) may be replaced by a deoxo reactor into which the exhaust gases, after their oxygen content has been adjusted, are fed together with a controlled amount of hydrogen gas.

8 Claims, 2 Drawing Figures

METHOD OF HEATING, HOLDING OR HEAT TREATMENT OF METAL MATERIAL

BACKGROUND OF THE INVENTION

The invention relates to a method of heating, holding or heat treatment of metal material in an atmosphere of processing gas consisting predominantly of nitrogen and produced at, or in close vicinity to the location where the heating, holding or heat treatment takes place.

In the metallurgical industry many heat treatment processes are carried out in an atmosphere of processing gas consisting to a great part, often 90 percent or more, of nitrogen gas. The processing gas sometimes is a pure protective gas serving to prevent an undesired influence on the material, such as surface oxidation, which would occur but for the protective gas. In other cases, the processing gas should play an active part in the process, e.g. bring about carburization or decarburization of the material. The above is also true for other processes which are not, strictly speaking, heat treatment processes but only serve to increase the temperature or to maintain the temperature constant, that is, serve for heating and holding, respectively. However, the term "heat treatment" is hereinafter used as a collective term embracing all the aforesaid processes.

Often the heat treatment takes place in very large furnaces which may be of a multiplicity of different types and may operate batchwise or continuously. Regardless of the type of furnace, equipment is provided to ensure that the desired atmoshpere is maintained in the furnace chamber during the heat treatment, that is, to ensure that the atmosphere is made up only of the processing gas, which is controlled at least in respect of its composition.

The processing gas is produced on the site, that is, within the plant or workshop where the heat treatment takes place. Usually the equipment for the production of the processing gas is located in very close vicinity to the furnace.

Very large quantities of the processing gas are required; a processing gas consumption of 500–1000 $m^3/h$ at a single plant is not uncommon. The principal raw material for the production of the processing gas is hydrocarbon gas (liquefied petroleum gas, natural gas and the like), which is thus consumed in considerable quantities; a processing gas consumption of 700 $m^3/h$ corresponds to an annual consumption of liquefied petroleum gas of 500 metric tons. The raw material cost for the processing gas therefore is substantial.

SUMMARY OF THE INVENTION

The present invention provides a possibility of drastically reducing the raw material cost for the processing gas in the cases where an installation which generates heat by the combustion of a suitable hydrocarbon fuel, such as liquefied petroleum gas or natural gas, is located at, or in close vicinity to, the location where the heat treatment takes place. The principal characterizing feature of the invention is that the exhaust gases from such an installation are used as the principal raw material for the production of the processing gas.

The invention is based on the realization of the fact that the exhaust gases of such an installation predominantly consist of nitrogen gas, that is, the predominant constituent of the processing gas.

Basically, any of the ordinary hydrocarbon fuels, such as fuel oil, may be used. However, because the processing gas should be virtually free of sulphur and ashes, at least the ordinary fuel oil grades must be disregarded in actual practice; the purification required by the exhaust gases produced by the combustion of such fuels renders their use uneconomical, at least if the purification is carried out by the techniques existing today. There are, however, many installations fired with liquefied petroleum gas, natural gas or other similar suitable gases which are of a size to make them useful as a source of raw material in carrying out the invention.

In many cases, possibly even the majority of cases suited for application of the invention, the installation producing the exhaust gas may be the furnace in which the heat treatment is carried out. The combustion of the hydrocarbon fuel used for the heating of the furnace chamber then is effected outside the furnace chamber so that the exhaust gases are kept away therefrom (indirect heating). In certain cases, the heating exhaust gases may also, or alternatively, be used for the production of processing gas for a different but neighboring furnace requiring hydrogen-based processing gas. If the furnace producing the exhaust gas does not itself require a processing gas atmosphere, the hydrocarbon fuel may be combusted within the furnace chamber of that furnace, which may thus be directly heated.

The invention will be explained in greater detail hereinafter with reference to the accompanying drawings, which illustrate two embodiments.

ON THE DRAWINGS

AS SHOWN ON THE DRAWINGS

Figure 1:
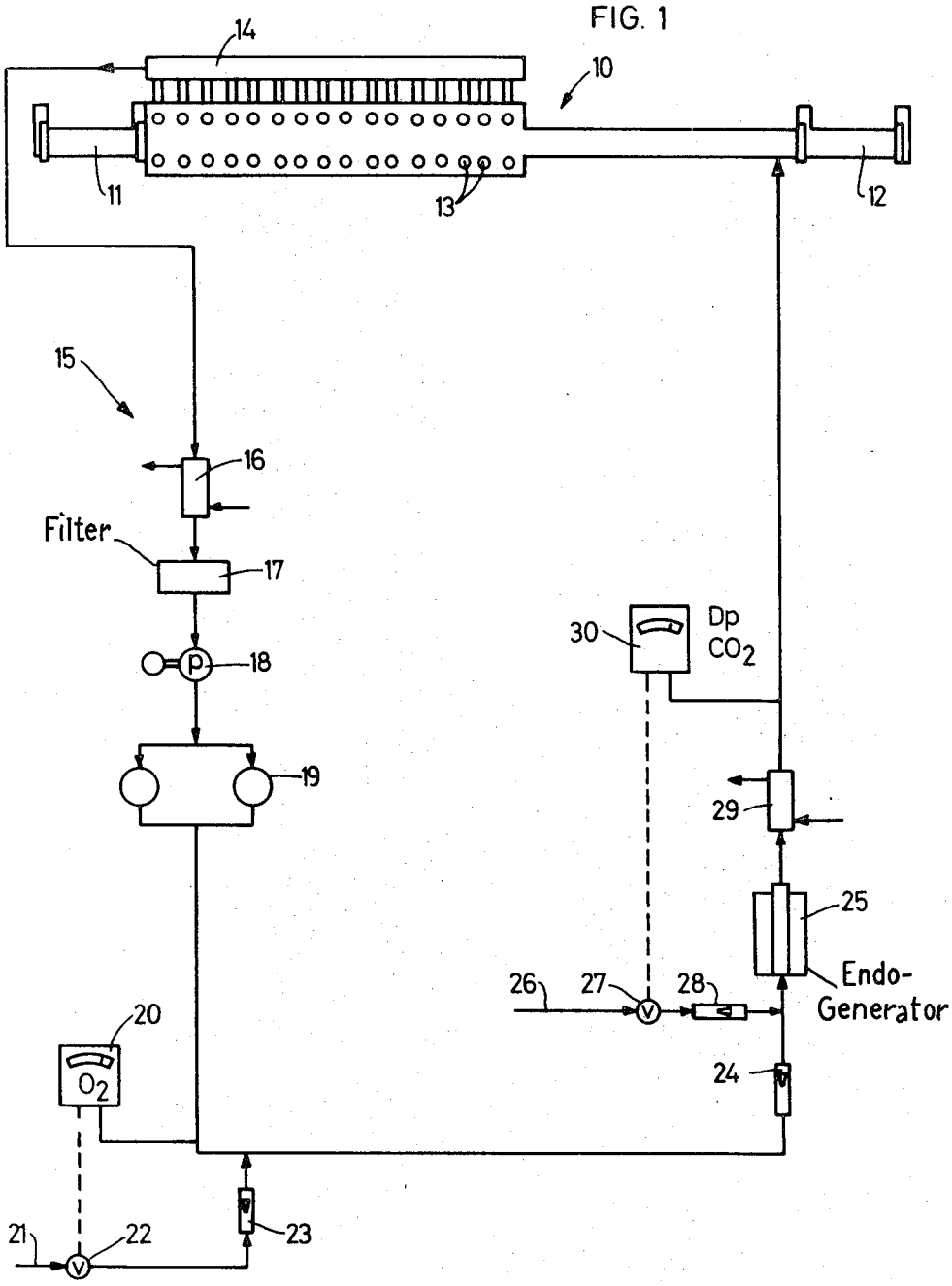
FIG. 1 is a diagrammatic illustration of a roller hearth furnace and an associated installation for producing a carbon-carrying processing gas for the furnace in accordance with the method of the invention.

The furnace 10 illustrated in the drawings is of a construction known per se. It is a continuous furnace and the material to be subjected to heat treatment in the furnace chamber of the furnace accordingly is continuously moved therethrough. At the ends of the closed, tunnel-like furnace chamber, gas locks 11 and 12 are provided to prevent the surrounding air from entering the furnace chamber.

The furnace chamber is indirectly heated by a large number of radiation tubes 13 fired with liquefied petroleum gas or a similar hydrocarbon gas. The exhaust gases are passed from the radiation tubes into a header conduit 14. Rather than passing the exhaust gases into the surrounding atmosphere as hitherto, the exhaust gases in the present case are continuously fed from the header conduit 14 into an installation, generally designated 15, for producing a processing gas which consists essentially of nitrogen, hydrogen and carbon monoxide and which is continuously fed to the furnace chamber immediately inwardly of the discharge gas lock 12.

The heating exhaust gases continuously flowing out from the header conduit 14 are at a temperature of 250°–300° C. and essentially consist of nitrogen, carbon dioxide (on the order of 10 percent by volume), oxygen (one or a few percent by volume) and water vapor (on the order of 10 percent by volume). The oxygen content is due to the fact that the combustion in the furnace is effected with a certain excess of air.

Initially, the temperature of the exhaust gases is lowered to 20°–30° C. in a cooler 16, which may form part of a heat recovery system. The exhaust gases then are passed through a filter 17 in which solid particles are removed, whereupon a pump 18 feeds the exhaust gases to a drier 19, where most of the carbon dioxide and the water vapor is removed. On the downstream side of the drier 19 the exhaust gases consist of one or a few percent by volume of oxygen, the balance being nitrogen (the unavoidable traces of carbon monoxide, water vapor, noble gases etc. are disregarded here).

The oxygen content of the exhaust gases is determined by means of an oxygen content meter 20, and through an air conduit 21 having a control valve 22 controlled by the meter 20 and a flow meter 23 sufficient air is fed to the exhaust gases to impart to them a predetermined oxygen content matching the desired carbon monoxide content of the processing gas.

The exhaust gases are then fed through a flow meter 24 to a so-called endo-generator 25. Before the exhaust gases enter the endo-generator 25, a controlled amount of liquefied petroleum gas is supplied through a conduit 26 including a control valve 27 and a flow meter 28; the quantity of said petroleum gas is relatively small in relation to the nitrogen content of the exhaust gases.

Within the endo-generator 25, thermal catalytic cracking of the petroleum gas is effected at a temperature of about 950° C., the carbon forming carbon monoxide with the oxygen of the exhaust gases. Leaving the endo-generator 25 is thus a gas mixture of nitrogen (which constitutes the predominant portion of the gas mixture), carbon monoxide and nitrogen as well as traces of carbon dioxide, water vapor, hydrocarbon gas and noble gases.

Downstream of the endo-generator 25 the gas mixture is cooled to a relatively low temperature (room temperature) in a cooler 29 whereupon it is fed as processing gas into a part of the furnace chamber serving as a cooling section, in which the processing gas flows in counter-current relation to the material being subjected to heat treatment.

The amount of liquefied petroleum gas supplied through the conduit 26 is controlled by a carbon dioxide content of dew point meter 30 which is connected downstream of the cooler 29 and thus ensures the proper value of the so-called carbon potential of the processing gas.

The processing gas continuously flowing from the furnace chamber may advantageously be used for scavenging the locks 11 and 12 in the manner described in Swedish published patent specification No. 364 729.

Figure 2:
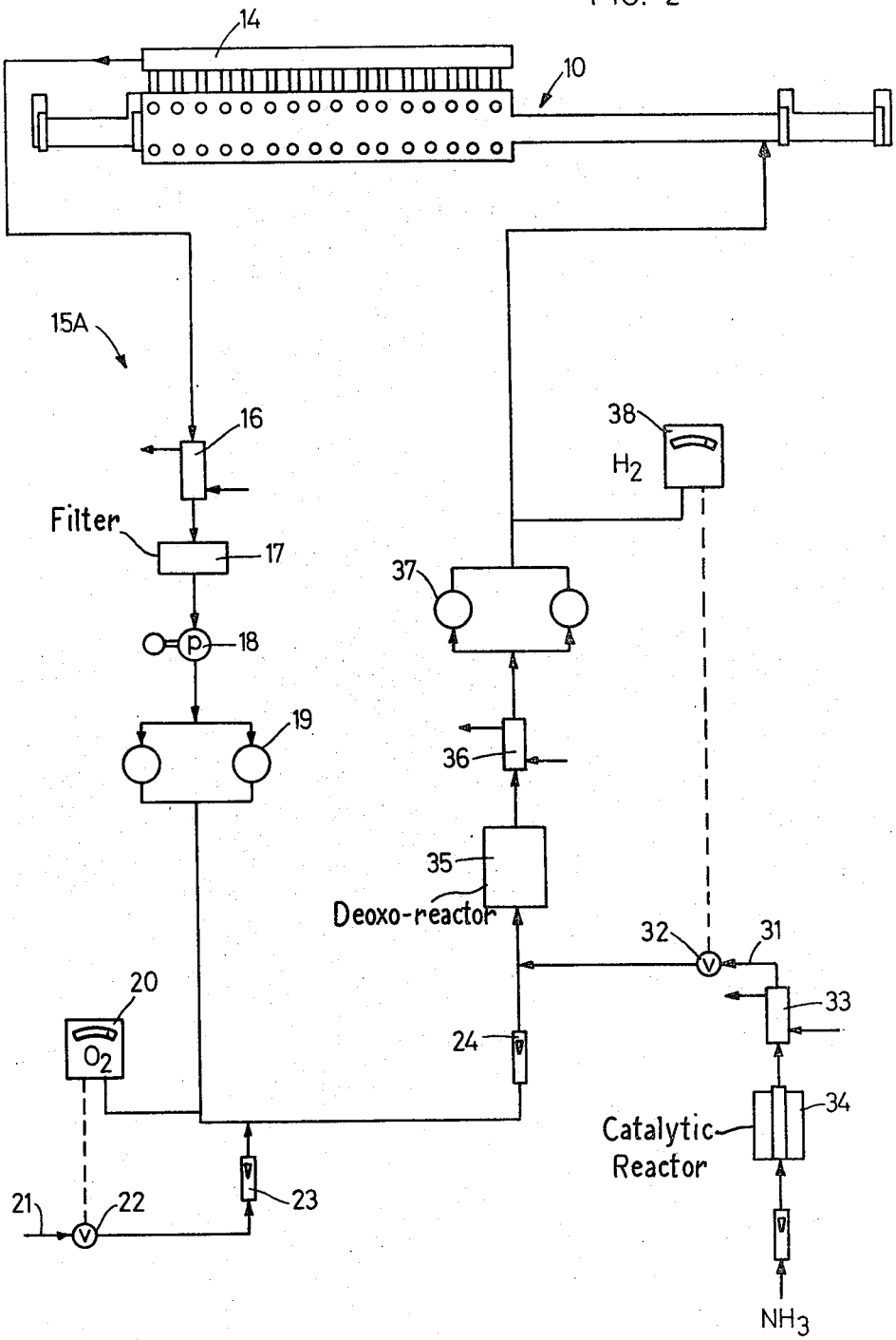
FIG. 2 is a diagrammatic illustration of the same furnace and an associated installation for producing a carbon-free processing gas for the furnace.

The installation shown in FIG. 2 for producing carbon-free processing gas is generally designated 15A and is identical with the installation of FIG. 1 in respect of certain elements which are therefore referenced by the same numerals in both figures. The installation 15A thus includes a cooler 16 connected to the header conduit 14 of the furnace 10, a filter 17, a pump 18, a drier 19, where carbon dioxide and water vapor are removed, an oxygen content meter 20 and an air conduit 21 including a control valve 22 controlled by the meter 20, and a flow meter 23. The installation moreover includes a flow meter 24 for the cooled, filtered and dried raw material gas admixed with oxygen up to a predetermined oxygen content of one or a few percent by volume.

Downstream of the flow meter 24 a controlled amount of so-called cracker gas is supplied through a conduit 31 including a control valve 32. This gas, which consists of hydrogen gas and nitrogen gas, is supplied through a cooler 33 from a catalytic reactor 34 to which ammonia is fed. Instead of the cracker gas, a different gas mixture of known hydrogen gas content or pure hydrogen gas may be supplied.

The raw material gas with the admixed hydrogen gas is introduced into a so-called deoxo-reactor 35 in which the gas mixture is subjected to complete combustion by means of a noble metal catalyst. The combustion, which raises the gas temperature to about 200° C., results in the formation of water vapor from the oxygen of the raw material gas and a portion of the hydrogen supplied through the conduit 31.

The resulting gas mixture consisting of nitrogen, hydrogen and water vapor (and minor quantities of other gases) is fed through a cooler 36 to a drier 37, in which the water vapor is removed, and is then supplied as relatively cool processing gas into the furnace chamber as in FIG. 1.

Downstream of the drier 37 a meter 38 is provided which measures the hydrogen content of the processing gas - which usually consists of 2 to 15 percent by volume of hydrogen and nitrogen as the balance - and controls the control valve 32 to bring it to pass an amount of gas matching the desired hydrogen gas content of the processing gas.

In the foregoing description the invention has been exemplified with particular reference to its application to a continuous furnace in which the amounts of exhaust and processing gases do not vary considerably with time. However, the invention is also applicable to batch furnaces and hybrid forms of continuous and batch furnaces. It is also within the scope of the invention to vary the quantity of processing gas produced per unit of time in dependence on the demand of processing gas and/or the availability of the exhaust gases and, if required, to temporarily store the processing gas in a buffer storage.

In its widest form, the invention is not limited to the above-mentioned metallurgical processes, that is, heating, holding or heat treatment of metal material, but also embraces within its scope other metallurgical processes which are carried out in an atmosphere of processing gas which consists essentially or predominantly of nitrogen gas and is produced at, or in close vicinity to, the location where the processes are carried out.

I claim:

1. Method of heating, holding or heat treatment of metal material in an atmosphere of processing gas consisting predominantly of nitrogen and produced at, or in close vicinity to, the location where the heating, holding or heat treatment takes place, characterized in that the processing gas is produced using as the principal raw material exhaust gases from an installation generating heat by the complete combustion of hydrocarbon fuel, the exhaust gases being substantially free of carbon dioxide and water vapor and having a predetermined oxygen content of one or a few percent by volume, and hydrogen being then added in an amount having a predetermined relationship to the oxygen content.

2. Method according to claim 1 in which the heating, holding or heat treatment takes place in a furnace having a furnace chamber heated indirectly by heating exhaust gases produced by the combustion of said hydrocarbon fuel, characterized in that said heating exhaust gases are used as the principal raw material for the processing gas.

3. Method according to claim 1, characterized in that the hydrogen is added as hydrocarbon gas, and in that the hydrocarbon gas of the resulting gas mixture is subjected to thermal cracking and reacted with the oxygen to form carbon monoxide and hydrogen gas.

4. Method according to claim 1, characterized in that the hydrogen is added as hydrogen gas in excess with respect to the oxygen of the exhaust gases and reacted with substantially all of the oxygen to form water, the excess of hydrogen being such that the resulting gas mixture has a predetermined content of hydrogen gas.

5. A method according to claim 1, said hydrocarbon fuel being liquified petroleum gas.

6. A method according to claim 1, the hydrocarbon fuel being natural gas.

7. A method according to claim 3, said hydrocarbon gas being liquified petroleum gas.

8. A method according to claim 3, said hydrocarbon gas being natural gas.

* * * * *